US011555369B2

(12) United States Patent
Al-Shehri

(10) Patent No.: US 11,555,369 B2
(45) Date of Patent: Jan. 17, 2023

(54) FISHING SCANNING TOOL

(71) Applicant: SAUDI ARABIAN OIL COMPANY, Dhahran (SA)

(72) Inventor: Sultan Abdulwahab Al-Shehri, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/185,351

(22) Filed: Feb. 25, 2021

(65) Prior Publication Data

US 2022/0268120 A1 Aug. 25, 2022

(51) Int. Cl.

| | |
|---|---|
| ***E21B 31/14*** | (2006.01) |
| ***E21B 47/12*** | (2012.01) |
| ***E21B 31/06*** | (2006.01) |
| ***E21B 47/002*** | (2012.01) |
| ***E21B 31/20*** | (2006.01) |
| *E21B 31/18* | (2006.01) |

(52) U.S. Cl.

CPC ..... *E21B 31/14* (2013.01); *E21B 31/06* (2013.01); *E21B 31/20* (2013.01); *E21B 47/002* (2020.05); *E21B 47/12* (2013.01); *E21B 31/18* (2013.01)

(58) Field of Classification Search

CPC ..... E21B 31/14; E21B 31/06; E21B 31/20; E21B 47/002; E21B 47/12

See application file for complete search history.

(56) References Cited

U.S. PATENT DOCUMENTS

| | | | | |
|---|---|---|---|---|
| 5,242,201 | A * | 9/1993 | Beeman | E21B 31/20 294/86.15 |
| 6,041,860 | A * | 3/2000 | Nazzal | E21B 29/10 73/152.01 |
| 10,677,039 | B1 * | 6/2020 | Avasarala | E02D 1/02 |
| 11,236,568 | B2 * | 2/2022 | Tiwari | E21B 31/06 |
| 2012/0048552 | A1 | 3/2012 | MacDougall et al. | |

(Continued)

FOREIGN PATENT DOCUMENTS

| | | |
|---|---|---|
| CN | 202970581 U | 6/2013 |
| CN | 202970582 U | 6/2013 |

(Continued)

OTHER PUBLICATIONS

Al-Hajri, NM et al.; "Successful Use of Downhole Camera Technology to Assist Fishing Operation;" 2017; SPE-188848-MS (10 pages).

(Continued)

*Primary Examiner* — Jennifer H Gay

(74) *Attorney, Agent, or Firm* — Osha Bergman Watanabe & Burton LLP

(57) ABSTRACT

A borehole fishing tool, including a grapple for fixedly attaching to a fish in a borehole, a tool housing to which the grapple is connected, and at least one camera, mounted in the tool housing, to generate at least one image of the fish in the borehole. The borehole fishing tool also includes at least one light source, mounted in the tool housing, to illuminating a portion of the borehole between the at least one camera and the fish, a connector attached to the tool housing to connect the tool housing to a conveyor, and a telemetry transceiver to transmit at least one image of the fish through a telemetry channel in the conveyor to a computer system at an Earth's surface.

5 Claims, 8 Drawing Sheets

(56) References Cited

U.S. PATENT DOCUMENTS

| | | | | |
|---|---|---|---|---|
| 2012/0151707 | A1* | 6/2012 | Lynde | B08B 9/043 15/339 |
| 2018/0266243 | A1 | 9/2018 | Malik et al. | |
| 2019/0301258 | A1* | 10/2019 | Li | E21B 47/09 |
| 2021/0396087 | A1* | 12/2021 | Tiwari | E21B 47/002 |

FOREIGN PATENT DOCUMENTS

| | | | | |
|---|---|---|---|---|
| CN | 203594395 | U | | 5/2014 |
| CN | 203594396 | U | | 5/2014 |
| CN | 104060962 | A | | 9/2014 |
| CN | 203808904 | U | | 9/2014 |
| CN | 104234653 | A | | 12/2014 |
| CN | 204357390 | U | | 5/2015 |
| CN | 105298424 | A | | 2/2016 |
| CN | 105587280 | A | * | 5/2016 |
| CN | 205445524 | U | | 8/2016 |
| CN | 206753531 | U | | 12/2017 |
| CN | 207960558 | U | | 10/2018 |
| CN | 207999230 | U | | 10/2018 |
| CN | 110005359 | A | | 7/2019 |
| CN | 209687448 | U | | 11/2019 |
| CN | 111622703 | A | * | 9/2020 |
| EP | 3375973 | A1 | * | 9/2018 ..... E21B 31/12 |
| GB | 2353055 | A | * | 2/2001 ..... E21B 23/002 |
| WO | WO-2004057149 | A1 | * | 7/2004 ..... E21B 31/005 |
| WO | 2013/117998 | A2 | | 8/2013 |
| WO | 2017/059539 | A1 | | 4/2017 |

OTHER PUBLICATIONS

Robert Mark De Jonge, et al.; "How Intelligent Coiled Tubing Technology Combined with Realtime Downhole Camera Visuals Created a Formula for Success During a Challenging Thru-Tubing Recompletion Operation in the North Sea;" 2017; SPE-170816-MS (9 pages).

* cited by examiner

FISHING SCANNING TOOL

BACKGROUND

In the course of drilling and completing boreholes to produce oil and gas from subterranean reservoirs, or while stimulating and producing hydrocarbons from subterranean reservoirs, it is not uncommon for equipment to be dropped in to the borehole from the surface or for downhole tools and equipment to become separated from their conveyor. When this occurs, it is frequently necessary to retrieve the dropped equipment or separated downhole tools from the borehole before normal drilling, completing, stimulating or producing operations may continue. This process of retrieval is commonly called "fishing" and the equipment or tools to be retrieved are commonly called "fish".

Fishing, when conducted blindly with no real-time visual information about the shape, location or orientation of the fish, can be a costly and time-consuming procedure.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a borehole fishing tool, including a grapple for fixedly attaching to a fish in a borehole, a tool housing to which the grapple is connected, and at least one camera, mounted in the tool housing, to generate at least one image of the fish in the borehole. The borehole fishing tool also includes at least one light source, mounted in the tool housing, to illuminating a portion of the borehole between the at least one camera and the fish, a connector attached to the tool housing to connect the tool housing to a conveyor, and a telemetry transceiver to transmit at least one image of the fish through a telemetry channel in the conveyor to a computer system at an Earth's surface.

In general, in one aspect, embodiments relate to a borehole fishing method that includes attaching, to a conveyor, a borehole fishing tool having at least one camera and inserting the borehole fishing tool attached to the conveyor into a borehole. Further, the method includes forming, using the camera(s), at least one image, in real-time, of a fish in the borehole and transmitting, through a telemetry channel in the conveyor, the image(s) of the fish in the borehole to a computer system on an Earth's surface. The method also includes engaging, guided by the image(s), the borehole fishing tool to the fish and confirming, based on the at least one image, the fixed attachment of the fish to the borehole fishing tool while retracting the conveyor from the borehole; and raising the borehole fishing device and the fish to the Earth's surface.

In general, in one aspect, embodiments relate to a borehole fishing system that includes, a computer system at an Earth's surface, a conveyor with a first end connected to the computer system and a second end retractably inserted into a borehole, and a borehole fishing tool connected to the second end of the conveyor. Further, the borehole fishing system includes a grapple attached to the borehole fishing tool to fixedly attach to a fish, at least one light source mounted on the borehole fishing tool, and at least one camera mounted on the borehole fishing tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to a fishing tool with a heavy-duty real-time video camera, i.e., a fish scanner. Utilizing such a fishing tool using any real-time intervention approaches (E-Coil—HeavydutyE-Line or TeleCoil) allows for transmission of wellbore images to the Earth's surface instantaneously, thereby resulting in straightforward confirmation of latching the fish and locating the fish when the fish is small and left in a horizontal section. In addition, embodiments disclosed herein provide a comprehensive overview of the well integrity using the real-time digital camera.

Figure 1:
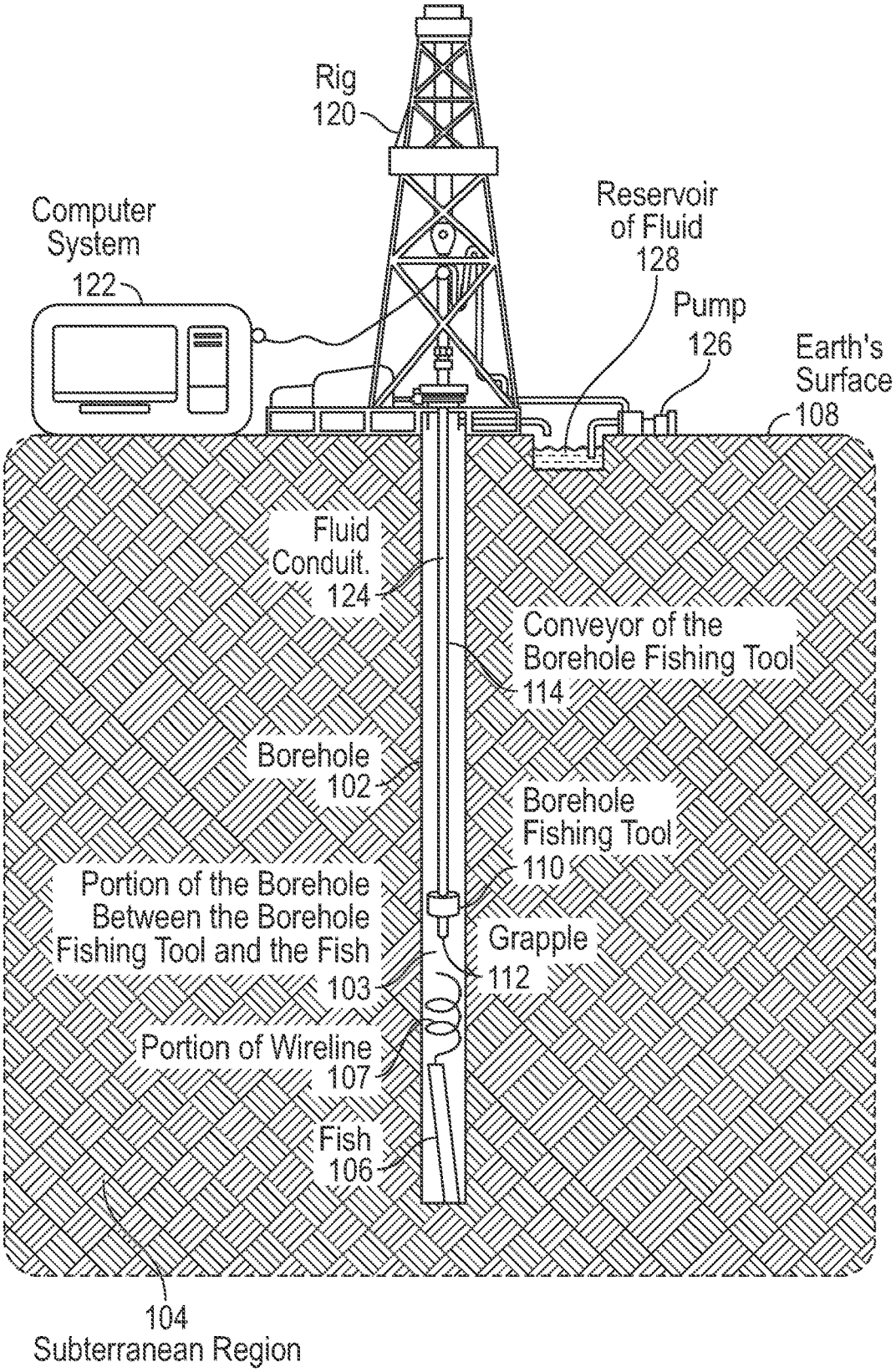
FIG. 1 shows a system, in accordance with one or more embodiments.
Figure 2D:
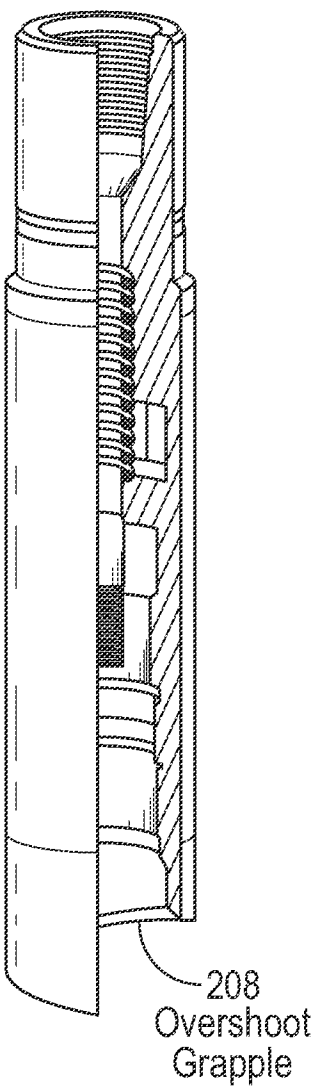
FIGS. 2A-2D show devices, in accordance with one or more embodiments.
Figure 2C:
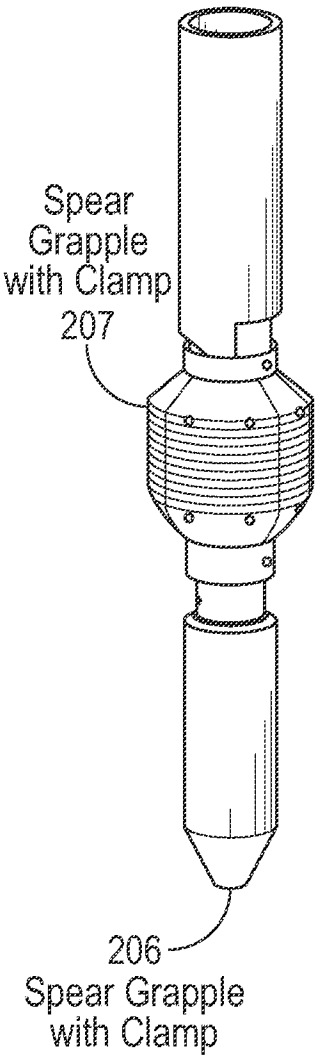
Figure 2B:
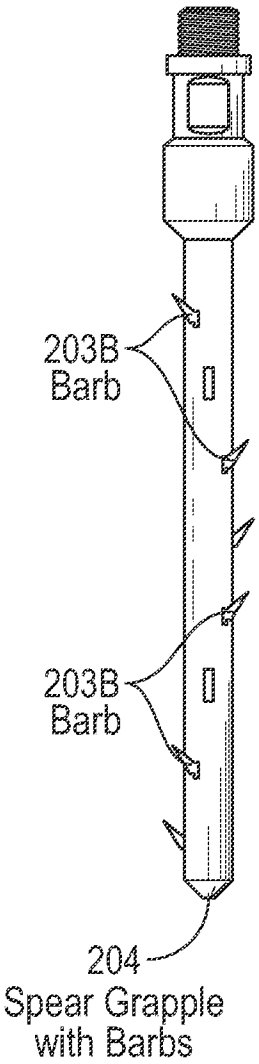
Figure 2A:
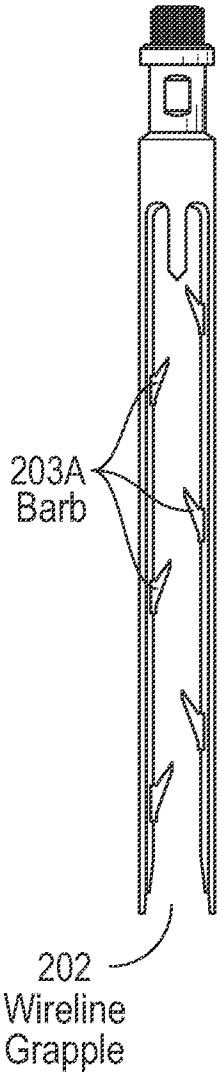

FIG. 1 illustrates a borehole (102) which may penetrate a subterranean region (104). The borehole (102) may contain a "fish" (106). The fish may be a piece of equipment, or a downhole tool, or a piece of completion, such as a portion of casing or tubing. The fish (106) may have been accidentally dropped into the borehole from the Earth's surface (108), or the fish (106) may have become accidentally separated from its conveyor, or the fish (106) may have become stuck in the borehole (102) and been deliberately separated from its conveyor.

FIG. 1 further illustrates, in accordance with one or more embodiments, a borehole fishing tool (110) deployed within the borehole (102). The borehole fishing tool (110) may be attached to a first end of a conveyor (114). The conveyor may extend from the borehole fishing tool (114) to the Earth's surface (108). A second end of the conveyor (114) may be attached to a means of suspension at the Earth's surface (108). The means of suspension may be a rig (120), or a coiled tubing unit (not illustrated), or a crane and winch (not shown).

In accordance with one or more embodiments, the conveyor may be contain a telemetry channel that may be connected at the first end of the conveyor to a telemetry transceiver in the borehole fishing tool, and connected at the second end of the conveyor to a computer system (122). The telemetry channel may be capable of transmitting signals, including still images and video images from the borehole fishing tool (110) to the computer system (122). The telemetry channel may be capable of transmitting commands from the computer system (122) to the borehole fishing tool (110).

The conveyor (114) of the borehole fishing tool (110) shown in FIG. 1 may, in accordance with one or more embodiments, be capable of inserting the borehole fishing tool (110) into the borehole (102) and conveying and retrieving the borehole fishing tool (110) from at least a portion of the borehole (102). The conveyor (114) may be a slickline, a wireline, a coil tubing, or a string of drill pipe. Further, the conveyor (114) of the borehole fishing tool (110) may be capable of lowering the borehole fishing tool into a substantially vertical borehole (102), and may be capable of pushing the borehole fishing tool (110) into a highly deviated borehole and/or a horizontal borehole. Further, the conveyor (114) may include a fluid conduit (124) extending from the rig (120) to the borehole fishing tool (110). One end of the fluid conduit of (124) of the conveyor (114) may be connected to a pump (126) in the rig (120) or on the Earth's surface (108). The pump (126) may pump fluid from a reservoir of fluid (128) into the fluid conduit (124). The fluid in the reservoir of fluid (128) may be a transparent fluid.

The borehole fishing tool (110) may be equipped with a grapple (112), in accordance with one or more embodiments. The grapple (112) may be capable of attaching to the fish (106) in such a manner as to connect the borehole fishing tool (110) to the fish (106).

Several forms of grapple (112), in accordance with one or more embodiments, are shown in FIG. 2. FIG. 2A shows a wireline grapple (202) intended to connect to a fish having a portion of wireline (107) attached to the proximal end of the fish (106). The wireline grapple has a plurality of barbs (203A) which may fixedly entangle the portion of wireline (107) attached to the proximal end of the fish (106). FIG. 2B, in accordance with other embodiments, shows a spear grapple (204) that may be attached to the borehole fishing tool (110) and may be inserted into a conduit in the fish (106). The spear grapple (204) may be include barbs (203B) to fixedly attach the borehole fishing tool (110) to the interior conduit within the fish (106). In accordance with other embodiments, FIG. 2C shows a spear grapple (206) that may include a clamp (207) that may be expanded inside a conduit within the fish (106) to clamp to the borehole fishing tool (110) to the fish (106). In accordance with still other embodiments, FIG. 2D shows an overshoot grapple (208) may be an overshoot grapple (208) that may slide over a fish (106) and fixedly attach to the exterior of the fish (106). The interior of the overshoot grapple may contain all manner of barbs and hooks (not shown) with which to latch to the fish (106).

Figure 3:
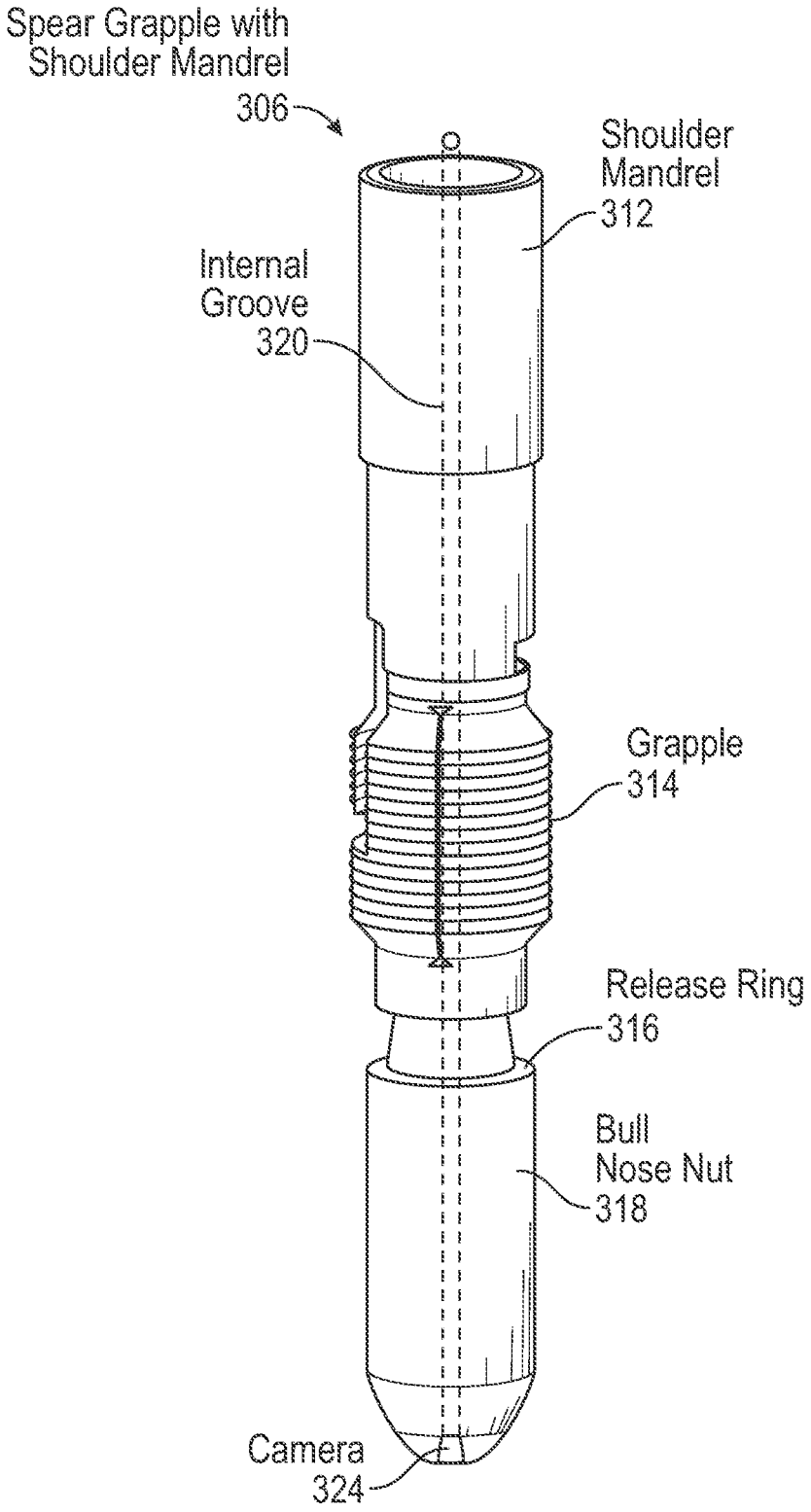
FIG. 3 shows a device, in accordance with one or more embodiments.

In accordance with one or more embodiments, FIG. 3 shows a spear grapple with clamp (306) with a camera (324) installed in the bull nose nut (318). The spear grapple with a clamp (306) includes a shoulder mandrel (312), a grapple (314), a release ring (316) and a bull nose nut (318). The shoulder mandrel (312) connects to a bottomhole assembly which may include a borehole fishing tool (110). The borehole fishing tool (110) may be connected to a conveyor (114) with a connector (not shown). The connector may be an API standard tool joint as specified in ISO 11961:2018, and ISO 10424-2 published by the International Organization for Standardization, or API Spec 7-2 published by the American Petroleum Institute. In other embodiments, the shoulder mandrel (312) may connect directly to the conveyor (114).

An internal groove (320) runs from the camera (324) through the bull nose nut (318), release ring (316), grapple (314) and shoulder mandrel (312). The internal grove (320) allows electrical and telemetry cables to connect the camera (324) to the shoulder mandrel (312). Further, the internal groove (320) may shield the camera (324) from stresses, shocks and vibrations experience by the grapple (306).

Figure 4:
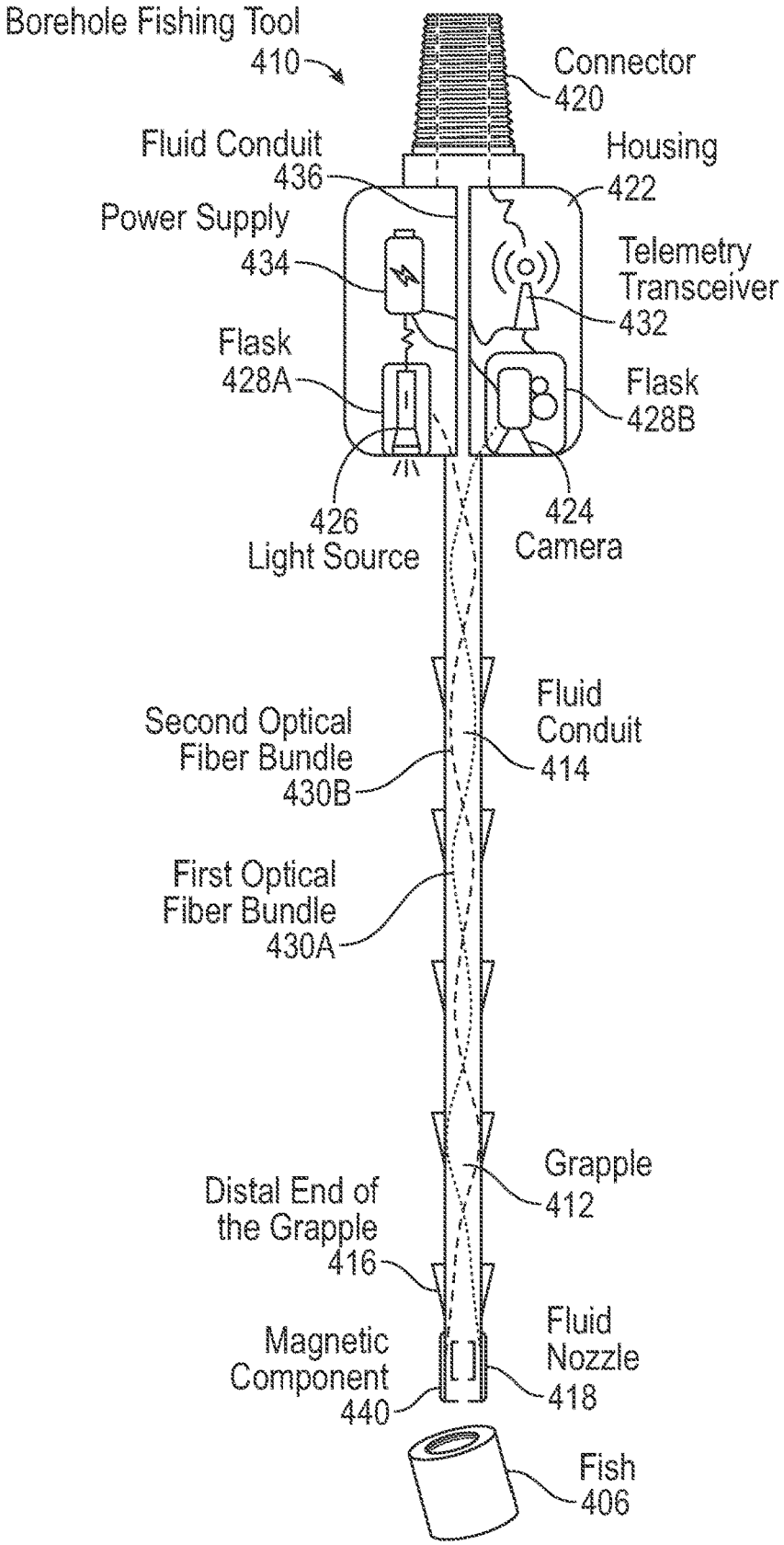
FIG. 4 shows a device, in accordance with one or more embodiments.

FIG. 4 illustrates a borehole fishing tool (410), in accordance with one or more embodiments. The borehole fishing tool (410) includes a connector (420) to connect the borehole fishing tool (410) to the conveyor (114). The connector may (420) include means for mechanical support, such as an API standard tool joint as specified in ISO 11961:2018, and ISO 10424-2 published by the International Organization for Standardization, or API Spec 7-2 published by the American Petroleum Institute. The connector may (420) include means for telemetry connectivity, such as the wired drill pipe connector described in "APPARATUS, SYSTEM, AND METHOD FOR COMMUNICATING WHILE LOGGING WITH WIRED DRILL PIPE" U.S. Pat. No. 8,791,832. The connector (420) with means for telemetry connectivity may permit the transmission and reception of signals and commands from the borehole fishing tool (410) to the telemetry channel in the conveyor, and from the telemetry channel in the conveyor and to the borehole fishing tool (410). In accordance with one or more embodiments, the borehole fishing tool (410) may further include a housing (422) to which the connector (420) is bonded. The bond may be a weld, a solder, a braze, and one or more fasteners such as screws, bolts, and rivets employed together or in combination.

In accordance with one or more embodiments, a grapple (412) may be bonded to the housing (422) using a weld, a solder, a braze, and one or more fasteners such as screws, bolts and rivets employed together or in combination. More specifically, the grapple (412) may be fixedly attached to the end of the housing (422) opposed to the end of the housing (422) to which the connector (420) is attached, in such a manner that when the borehole fishing tool (410) is suspended freely under gravity vertically from the conveyor (114), the grapple (412) extends substantially vertically below the housing (422) of the borehole fishing tool (410). The grapple (412), in accordance with one or more embodiments, may without limitation be a wireline grapple (202), a spear grapple with barbs (204), a spear grapple with clamp (206), a overshoot grapple (208), or any other design of grapple known to one of ordinary skill in the art.

In accordance with one or more embodiments, one or more cameras (424) may be mounted in the housing (422).

The one or more cameras (424) may be configured to generate one or more still images, and/or video images. The one or more cameras (424) may be configured to have a field of view that includes the scene below the borehole fishing tool (410). The field of view may include the grapple (412) and/or a portion of the borehole (103) beneath the grapple (412).

In accordance with one or more embodiments, the camera(s) (424) may be compatible with live or real-time imaging. Live/real-time video (movie) signals may be sent in real-time from the telemetry transceiver (432) to the computer system (122) at the rig (120) when large bandwidth telemetry traversing the conveyor (114) is available. Large bandwidth telemetry may include, without limitation, optical fiber telemetry and wired drill pipe telemetry. According to other embodiments, still image data may be sent to the computer system (122) at the rig (120) in real-time when using small bandwidth telemetry. small bandwidth telemetry may include, without limitation, mud-pulse telemetry and electromagnetic induction telemetry. In some embodiments, the camera(s) (424) may further include includes a processor and a memory containing instructions for execution by the processor. The instructions, if executed by the processor, apply an image processing algorithm to reduce the number of captured image frames sent to the computer system (122), or to reduce the amount of data sent to the computer system (122), or combinations thereof.

In accordance with some embodiments, it may be desirable for the camera (424) to operate in high temperature environments. High temperatures may be temperatures of 375° F. or higher. In these cases, the camera (424) may be enclosed in a flask (428B) to allow the camera (424) to operate at a lower temperature than the environment surrounding the borehole fishing tool (430). The flask (428B) may include a heat sink that includes a material designed to absorb the heat produced by the camera (424), or heat penetrating the flask (428B) from the exterior while minimizing the increase in temperature. The flasks (428B) may be enclosed within a pressure housing, or the flask (428B) may also function as a pressure housing to protect the camera (424) from high ambient pressures in the borehole (102). The high ambient pressure may be 25 kilopounds per square inch (kpsi) or greater. In accordance with one or more embodiments, the flask (428) may protect the camera (424) enclosed from shocks and vibration that may be experienced during transportation to the borehole site and during insertion and retrieval from the borehole (102).

In accordance with some embodiments, a camera (424), whether or not enclosed in a flask (428B), may be configured to receive light from a second optical fiber bundle (430B) extending from the camera (424) to the distal end (416) of the grapple (412). Light entering the second optical fiber bundle (430B) at the distal end (416) of the grapple (412) be directed to camera (424) by the second optical fiber bundle (430B) where an image of the scene including the fish (406) may be formed. The second optical fiber bundle (430B) may consist of one or more optical fibers. In accordance with other embodiments, the camera may be mounted in the distal end of the grapple (416) and electrically connected to power supply (434) and telemetry transceiver by the second optical fiber bundle (430B) that further includes electrical conductors.

In accordance with one or more embodiments, one or more light sources (426) may be mounted in the housing (422). The one or more light sources (426) may be configured to illuminate the scene below the borehole fishing tool (410). The illuminate scene may include the grapple (412) and a portion (103) of the borehole (102) beneath the grapple (412). The one or more light sources (426) may, in accordance with one or more embodiments, utilize an incandescent lightbulb, such as a quartz lamp to illuminate a portion (103) of the borehole. In other embodiments, a compact fluorescent lightbulb (CFL) and/or a low power incandescent lamp may be used to reduce the power requirements. In one or more embodiments the light sources (426) may utilize at least one light-emitting diodes (LEDs). LEDs have many advantages over incandescent and CFL, including lower energy consumption, longer lifetime, improved physical robustness, smaller size, and faster switching. The light sources (426) may combine any type of lightbulb with a curved mirror, or an array of mirrors place behind the LEDs to maximize the power of the illumination in a preferred direction, that may be the direction of the scene including the fish (406).

In accordance with some embodiments, it may be desirable for the light sources (426) to operate in high temperature environments. High temperatures may be temperatures of 375° F. or higher. In these cases, a light source may be enclosed in a flask (428A) to allow the lightbulbs, whether incandescent, CFL, or LED to operate at a lower temperature than the environment surrounding the borehole fishing tool (430). The flask (428A) may include a heat sink that includes a material designed to absorb the heat produced by the lightbulbs, or heat penetrating the flask (428A) from the exterior while minimizing the increase in temperature. The flask (428A) may be enclosed within a pressure housing, or the flask (428A) may also function as a pressure housing to protect the lightbulbs from high ambient pressures in the borehole (102). The high ambient pressure may be 25 kpsi or greater.

In accordance with some embodiments, a light source (426) whether or not enclosed in a flask (428A) may be configured to direct light into a first optical fiber bundle (430A) extending from the light source (426) to the distal end (416) of the grapple (412). Light traversing the first optical fiber bundle (430A) may at the distal end (416) of the grapple (412) be directed to illuminate the scene including the fish (406). The first optical fiber bundle (430A) may consist of one or more optical fibers.

The housing (422) may contain (4(4*a* telemetry transceiver (432) configured to transmit signals from the one or more cameras (424) to the Earth's surface (108) through the telemetry channel within the conveyor (114). The housing (422) (4may also include a power supply (434) to provide electrical power to the one or more cameras (424) and to the one or more light sources (426). The housing (426) may contain a fluid conduit (426) that traverses the housing (422). A first end of the fluid conduit (426) may connect to the fluid conduit (124) in the conveyor (114), and a second end of the fluid conduit (426) may connect to a fluid conduit (414) that traverses the length of the grapple (412).

In accordance with one or more embodiments, the housing (422), light source(s) (426), camera(s) (424) and flasks (428A, 328B) may be manufactured from, coated with, or enclosed within, materials designed to resist and withstand downhole environmental conditions. In particular, these materials may be designed to resist and withstand fluids containing $H_2S$ and high pressures and high temperatures. Material that exhibit these characteristics are listed in the NACE MR0175/ISO 15156 standard of prequalified materials for use in upstream oilfield equipment where sulfide-induced stress corrosion cracking may be a risk in sour environments, i.e., in oil/gas/seawater mixtures where hydrogen sulfide ($H_2S$) is present. NACE MR0175/ISO 15156 is published by the National Association of Corrosion Engineers.

In accordance with one or more embodiments, the grapple (412) may include a fluid conduit (414) traversing the length of the grapple (412) which is connected to another fluid conduit (436) traversing the housing (422) of the borehole fishing tool (4310). The fluid conduit (436) traversing the housing (422) of the borehole fishing tool (410) may also connect to a third fluid conduit (124) traversing the conveyor (414) from the Earth's surface (108) to the borehole fishing tool (410). All three fluid conduits (i.e., the fluid conduit (124) traversing the conveyor (114) and the fluid conduit (436) traversing the housing (422) and the fluid conduit (414) traversing the length axis of the grapple (412)), may in accordance with one or more embodiments, allow fluid to be pumped from a reservoir of fluid (128) at the Earth's surface (108) to the distal end of the grapple (416) and through a fluid nozzle (418) into a portion (103) of the borehole (102) between the housing (422) or the borehole fishing tool (410) and the fish (406). The fluid pumped through into the portion (103) of the borehole (102) between the housing (422) or the borehole fishing tool (410) and the fish (406) may be a transparent fluid, such as fresh water, brine, liquid nitrogen, and liquid $CO_2$.

It will be evident to one of ordinary skill in the art, that the systems and methods described herein do not require replacing the fluid in the entire borehole (102) with a transparent fluid, but require only replacing a limited volume of fluid occupying the portion (103) of the borehole (102) enclosing the light sources (426), camera(s) (424), and the fish (418). This transparent fluid may displace an opaque fluid between fish (406) and downhole camera (424) lens, rendering fish (406) visible for a period of time.

The distal end (416) of the grapple (412) may include a magnetic component (440), in accordance with one or more embodiments. The magnetic component (440) may be a permanent magnet or a controllable electromagnetic, according to one or more embodiments. The magnetic component (440) may be part of the fluid nozzle (418). The magnetic component (440) may cause the distal end (416) of the grapple (412) to be attracted to metallic fish (406), thereby making it easier to fixedly attach the grapple to the metallic fish (406).

Figure 5:
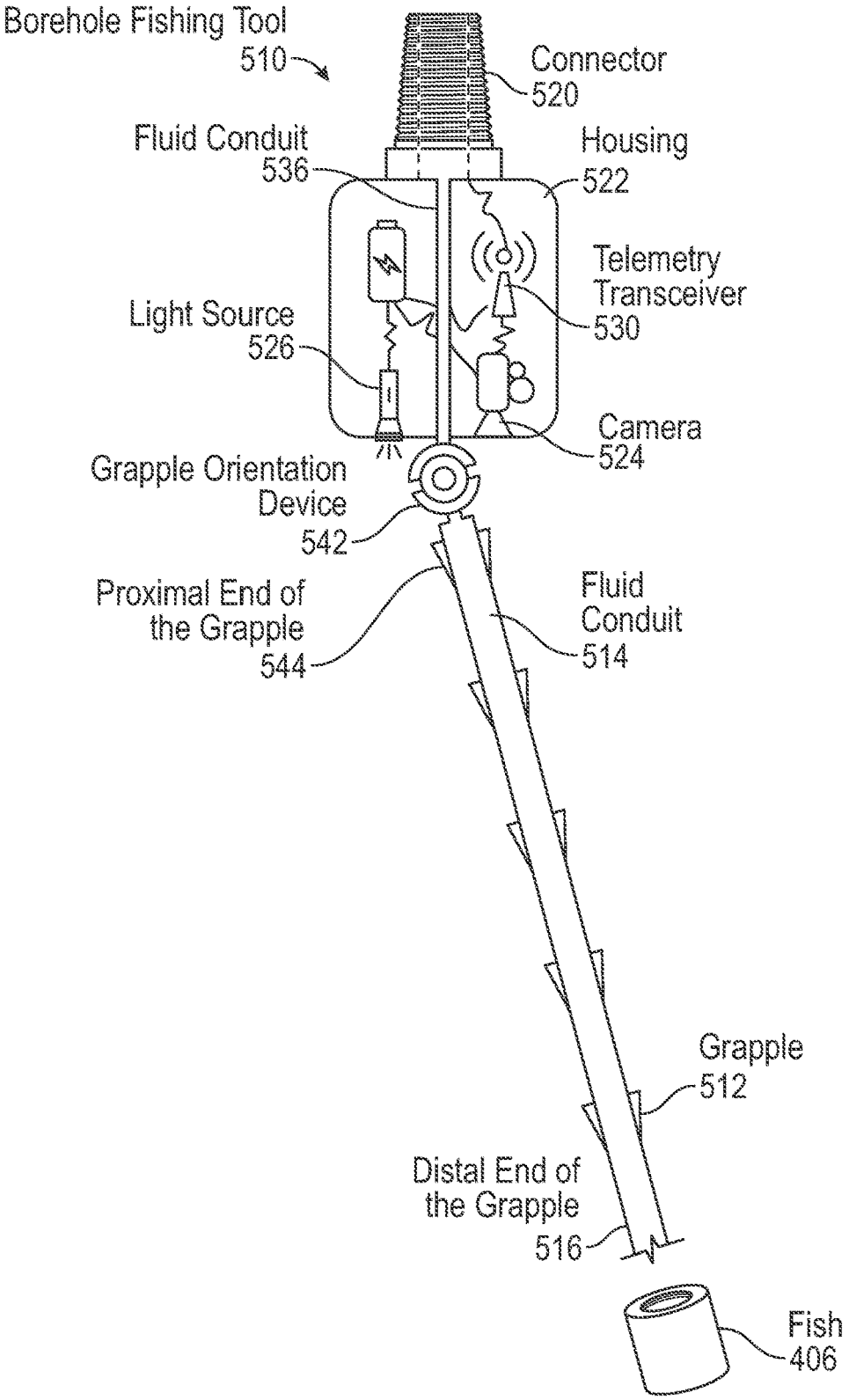
FIG. 5 shows a device, in accordance with one or more embodiments

FIG. 5 shows a borehole fishing tool (510) in accordance with one or more embodiments. Specifically, FIG. 5 shows a grapple orientation device (542) positioned between the proximal end (544) of the grapple (512) and the housing (522) of the borehole fishing tool (510). In accordance with one or more embodiments, the grapple orientation device (542) allows the orientation of the grapple (512) with respect to the housing (522) or the borehole fishing tool (510) to be controllably changed in at least one plane. In accordance with other embodiments, the orientation of the grapple (512) with respect to the housing (522) or the borehole fishing tool (510) to be controllably changed in two orthogonal planes. Commands may be sent to the grapple orientation device (542) from an operator on the Earth's surface (108) through the telemetry channel (604) in the conveyor (114) in response to signals transmitted from the camera(s) (524) through the telemetry channel (604) within the conveyor (114) and received at the Earth's surface (108) by a computer system (122).

Figure 6:
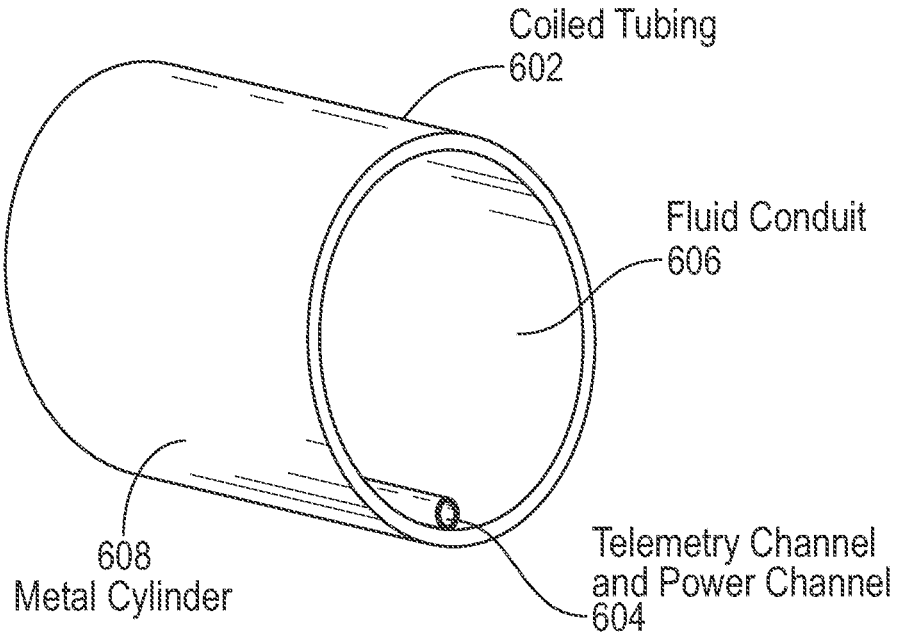
FIG. 6 shows a device, in accordance with one or more embodiments.

FIG. 6 shows a segment of coiled tubing in accordance with one or more embodiments. The coiled tubing (602) may be the conveyor (114) of the borehole fishing tool (510). The coiled tubing (602) may be a continuous metal cylinder (608). The diameter of the metal cylinder (608) may be 2 inches or may be bigger or smaller than 2 inches. The length of metal cylinder (608) may be equal to the length of the borehole (102), in accordance with one or more embodiments. In accordance with other embodiments the length of the metal cylinder (608) may be larger or smaller than the length of the borehole (102). When not inserted into the borehole the metal cylinder (608) may be coiled on a large spool or drum on the Earth's surface (108).

In accordance with one or more embodiments, the interior of the coiled tubing (602) may form a fluid conduit (606) from the Earth's surface (108) to the downhole end of the coiled tubing (602). In accordance with one or more embodiments, a fluid may be pumped from the Earth's surface (108) through the interior of the coiled tubing (602) forming the fluid conduit (606) to the downhole end of the coiled tubing (602). The fluid may be a transparent fluid, such as fresh water or brine. The downhole end of the coiled tubing (602) may be attached to the connector (520) or the borehole fishing tool (510), and the fluid may flow from the downhole end of the coiled tubing (602) through the conduit traversing the housing of the borehole fishing tool (510) and the fluid conduit (514) within the grapple (512) and exit through the distal end of the grapple (516) into the portion of the borehole (103) between the borehole fishing tool (510) and the fish (506).

In accordance with one or more embodiments, a telemetry channel (604) may run inside the coiled tubing (602) along the entire length of the coiled tubing (602). The telemetry channel (604) may comprise a slick line, or a wireline, or an optical fiber cable. In some embodiments, element of a slick line, a wireline, and an optical fiber cable may be combined to form the telemetry channel (604). In accordance with one or more embodiments, the telemetry channel (602) may also be configured to convey power from the surface to the downhole end of the coiled tubing (602). According to one or more embodiments, the coiled tubing (602) with a telemetry and power channel (604) may be TeleCoil™ (a Trademark of Baker Hughes).

In accordance with one or more embodiments, the fluid within the fluid conduit (606) also forms a telemetry channel. Acoustic wave signals may be transmitted from the downhole end of the coiled tubing (602) to the Earth's surface (108) through the fluid in the fluid conduit (606). Acoustic wave signals may also be transmitted in the reverse direction, from the Earth's surface (108) to the downhole end of the coiled tubing (602) through the fluid in the fluid conduit (606). In accordance with other embodiments, acoustics signal may be transmitted in both directions, from the downhole end of the coiled tubing (602) to the Earth's surface (108) and from the Earth's surface (108) to the downhole end of the coiled tubing (602).

In accordance with one or more embodiments power may be transmitted through the fluid conduit (606). Fluid may be pumped from the Earth's surface (108) to the downhole end of the coiled tubing (602), where the flow of pumped fluid may cause a turbine to generate electrical power.

Figure 7:
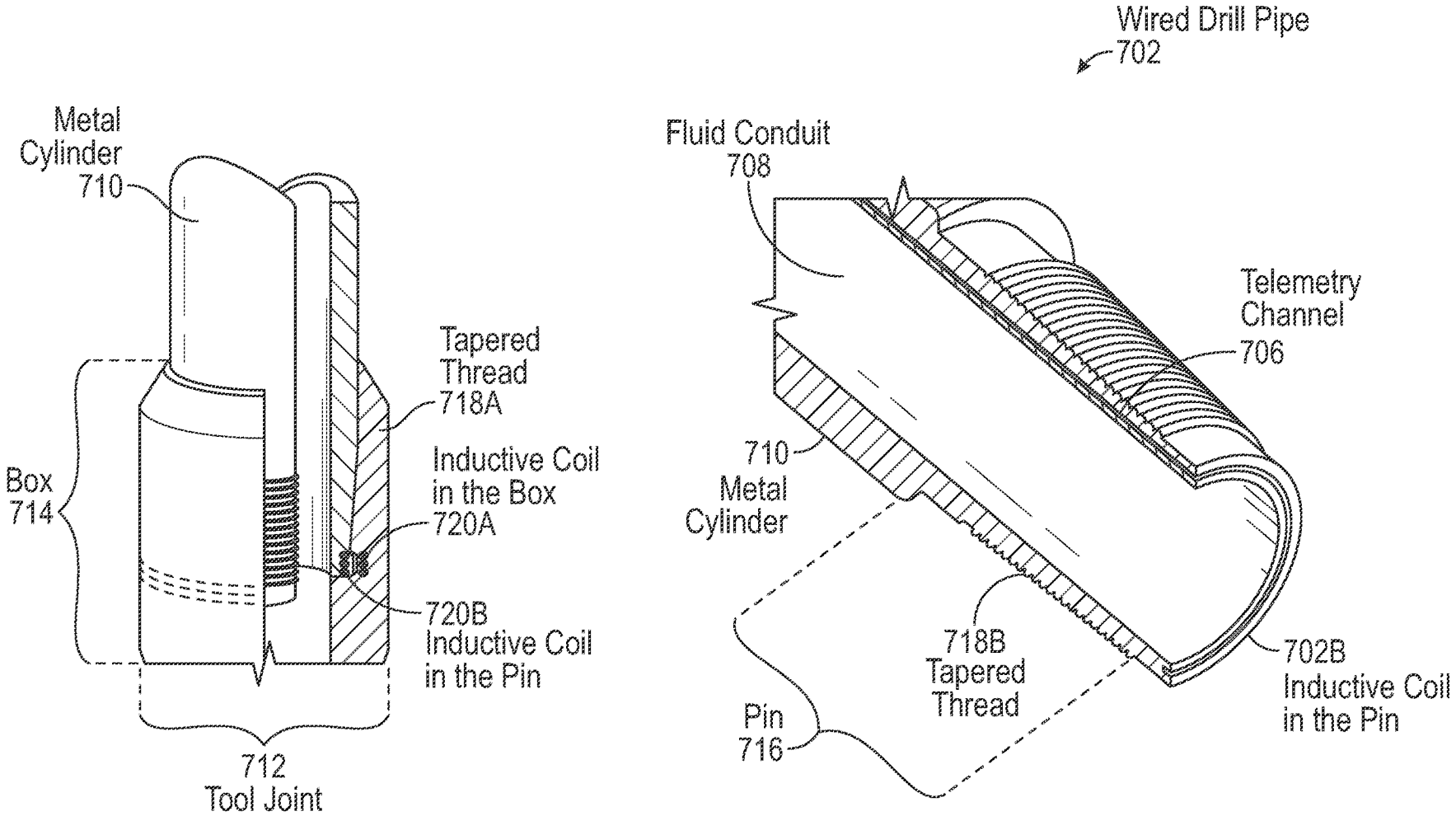
FIG. 7 shows devices, in accordance with one or more embodiments.

FIG. 7 shows elements of a wired drill pipe (702) in accordance with one or more embodiment. The wired drill pipe (702) may be the conveyor (114) of the borehole fishing tool (510). The wired drill pipe (702) may be an ensemble of metal cylinders (704) screwed together at tool joints (710). The diameter of the metal cylinder (710) may be 2 inches or the diameter may be bigger or smaller than 2 inches. In accordance with one or more embodiments the interior of the metal cylinders (710) may form a fluid conduit (708). In accordance with one or more embodiments, a fluid may be pumped from the Earth's surface (108) through the fluid conduit (708) to the downhole end of the wired drill pipe (702). According to one or more embodiments, the fluid may be a transparent fluid, such as fresh water or brine. The downhole end of the wired drill pipe (702) may be attached to the connector (520) or the borehole fishing tool (510), and the fluid may flow from the downhole end of the coiled tubing (6(502) through the conduit traversing the housing of the borehole fishing tool (510) and the fluid conduit (514) within the grapple (512) and exit through the distal end of the grapple (516) into the portion of the borehole (103) between the borehole fishing tool (510) and the fish (506).

Each metal cylinder, which may be denoted a "segment" of wired drill pipe, may be 30 feet in length. In accordance with one or more embodiments, the length of each segment may be larger or smaller than 30 feet. A plurality of segments of wired drill pipe (702) may be connected to one another to reach from the Earth's surface (108) to the borehole fishing tool (110, 410) positioned in the borehole (102). Such a plurality of segments of wired drill pipe may be called a "string" of wired drill pipe. Each segment of wired drill pipe may have a telemetry channel (706) running along its length positioned at, or near, the interior surface of the metal cylinder (710). In accordance with one or more embodiments, the telemetry channel (706) may be an armored coaxial cable. Two segments of wired drill pipe may be joined at a tool joint (712). A tool joint (712) may consist of a "box" (714) and a "pin" (716). In accordance with one or more embodiments the box (714) may have a tapered thread (718A) on its interior surface, and the pin (716) may have a tapered thread (716B) on its outer surface. Both the tapered threads (718A, 618B) may be configured so the pin (716) of one segment of wired drill pipe (702) may be inserted into the box (714) of another segment of wired drill pipe (702) and the two segments may be screwed securely together.

In accordance with one or more embodiments, the telemetry channel (706) may terminate at both ends of the segment of wired drill pipe (702) in an inductive coil (720A, 620B). At one end of the segment of wired drill pipe (702) the inductive coil (702A) may be wound around the interior surface of the box (714). At the other end of the segment of wired drill pipe (702) the inductive coil (702B) may be wound around the exterior surface of the pin (716). The inductive coil in the box (720A) and the inductive coil in the box (720B) are each configured such that when the two segments of wired drill pipe (702) are screwed securely together the inductive coil in the box (720A) and the inductive coil in the pin (720B) may be proximity to one another, such that electrical inductive coupling between the inductive coil in the box (720A) and the inductive coil in the pin (720B) may occur and electrical signals may be passed from one inductive coil to the other in both directions. In accordance with one or more embodiments, the wired drill pipe may be IntelliServe™.

In accordance with one or more embodiment, the fluid within the fluid conduit (708) may also forms a telemetry channel. In this case, armored coaxial cable along each segment of drill pipe, and inductive coupling coils at each end of each segment of drill pipe is unnecessary. In accordance with one or more embodiment, acoustic wave signals may be transmitted from the downhole end of the string of drill pipe to the Earth's surface (108) through the fluid in the fluid conduit (708). In accordance with one or more embodiments, acoustic wave signals may be transmitted from the Earth's surface (108) to the downhole end of string of drill pipe through the fluid in the fluid conduit (708). In accordance with other embodiments, acoustics signal may be transmitted in both directions, from the downhole end of the string of drill pipe to the Earth's surface (108) and from the Earth's surface (108) to the downhole end of the string of drill pipe.

In accordance with one or more embodiments power may be transmitted through the fluid conduit (708). Fluid may be pumped from the Earth's surface (108) to the downhole end of the string of drill pipe, where the flow of pumped fluid may cause a turbine to generate electrical power.

Figure 8:
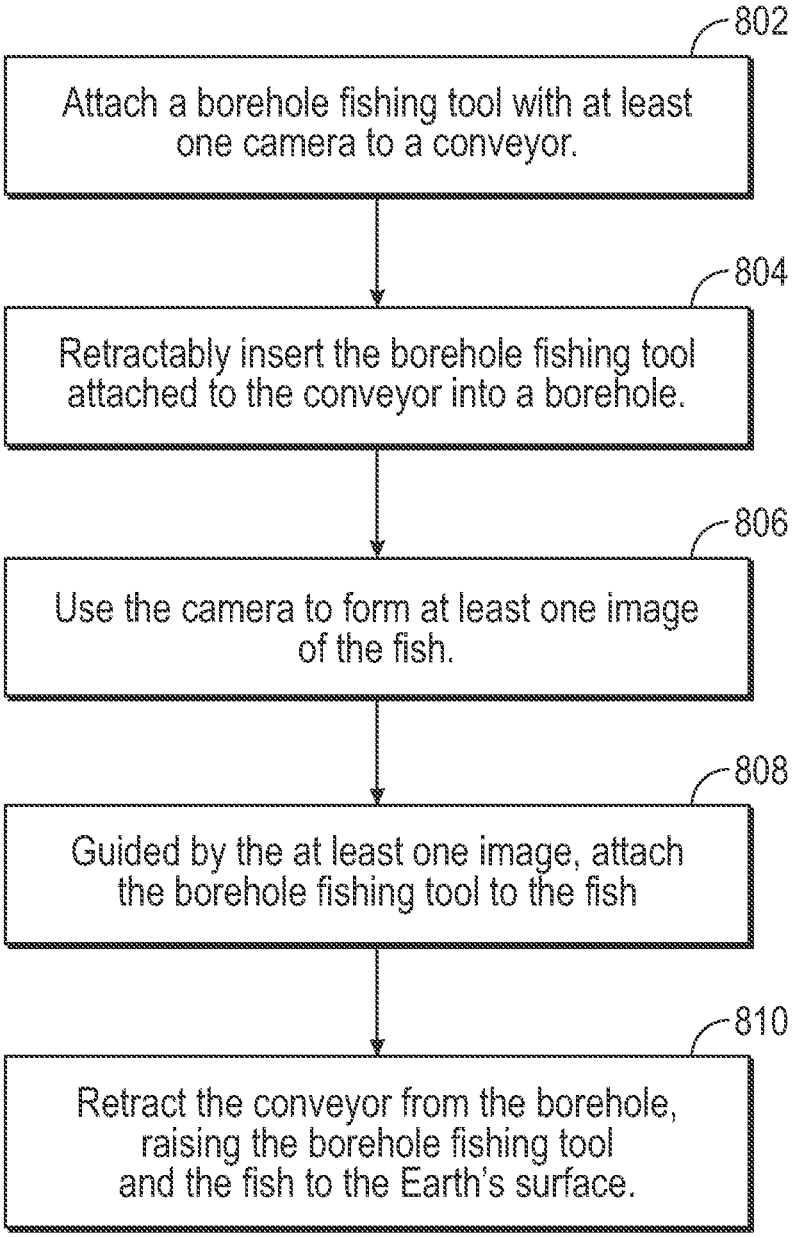
FIG. 8 shows a flowchart, in accordance with one or more embodiment.

FIG. 8 shows a flowchart that illustrates the use of a borehole fishing tool, as described with respect to FIGS. 3-7 above, in accordance with one or more embodiments. One or more blocks in FIG. 8 may be performed using one or more components as described in FIGS. 1 through 6. While the various blocks in FIG. 8 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In Step 802, a borehole fishing tool (510) including at least one camera (524) may be attached to a conveyor. The conveyor may be a coiled tubing, a wired coil tubing, a string of drill pipe, a string of wired drill pipe, a wireline, or a slick line. The borehole fishing tool (510) may further include one or more light sources (526), a grapple (512), a grapple orientation device (542), and a fluid conduit (512) to pump a transparent fluid into the portion (103) of the borehole (102) between the borehole fishing tool (510) and the fish (506).

In Step 804, the borehole fishing tool (510) may, in accordance with one or more embodiments, be retractably inserted into the borehole (102) by the conveyor. The borehole fishing tool (510) may be insert to the approximate anticipated location of the fish (506).

In Step 806, in accordance with one or more embodiments, at least one image of the fish may be generated by at least one camera, and the at least one image of the fish may be transmitted to a computer system (122) on the Earth's surface (108) through a telemetry channel within the conveyor (114). In accordance with one of more embodiments, the at least one image may be a plurality of still images, or a series of video images, or a combination of still and video images. The generation of at least one image may, in accordance with one or more embodiments, further include pumping a transparent fluid, such as fresh water or brine, from the Earth's surface (108) through the fluid conduit within the conveyor, through the fluid conduit within the borehole fishing tool (510) and through the grapple (512), to the portion (103) of the borehole (102) between the borehole fishing tool (510) and the fish (506). In accordance with one or more embodiments, the formation of at least one image may further include illuminating the scene below the borehole fishing tool (510) which may include the fish (506) using at least one light source (526) mounted in the housing (522) of the borehole fishing tool (510).

In Step 808, in accordance with one or more embodiments, the borehole fishing tool (510) may be fixedly attached to the fish (506) guided by the at least one image generated by the camera (524). Guiding the borehole fishing tool (510) may further include viewing at least one image generated by the camera (524) and based on the at least one image issuing commands via a computer system (122) and transmitted through the telemetry system of the conveyor (114) to the borehole fishing tool (510). These commands may cause the grapple orientation device (544) to change the orientation of the grapple (512) to facilitate fixedly attaching the borehole fishing tool (510) with the grapple (512) to the fish (506). In accordance with one or more embodiment, guiding the borehole fishing tool (510) may further include changing the position or orientation of the borehole fishing tool (510) using the conveyor (114). Changing the position of the borehole fishing tool (510) may include any combination of raising, lowering, pushing, pulling, and rotating the borehole fishing tool (510) using the conveyor (114).

In Step 810, in accordance with one or more embodiments, the conveyor may be retracted from the borehole (102), raising the borehole fishing tool (510) and the fish (506) to the Earth's surface (108). Raising the borehole fishing tool (510) and the fish (506) to the Earth's surface (108) may further include monitoring a visual display of the at least one image of the grapple (512) and the fish (506) to ensure that the fish is fixedly attached to the borehole fishing tool (510) with the grapple (512) at the beginning of the retraction operation. Raising the borehole fishing tool (510) and the fish (506) to the Earth's surface (108) may further include monitoring a visual display of the at least one image of the grapple (512) and the fish (506) to ensure that the fish remains fixedly attached to the borehole fishing tool (510) with the grapple (512) at least until the fish (506) reaches the Earth's surface (108).

Embodiments disclosed herein provide a device and method for locating the left in hole (LIH) junk and fish it in one run. The fish engagement (latching) may be confirmed without the need to pull to surface due to having a live video reflecting wellbore condition in the same run. Thus, embodiments disclosed herein enhance fishing operations by saving time and improve fishing operation efficiency by increasing the chances of latching the LIH fish using the real-time images or video from the camera on the fishing tool. The camera also simultaneously provides an overview of the wellbore condition.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. A borehole fishing method, comprising:

attaching, to a conveyor, a borehole fishing tool having at least one camera; inserting the borehole fishing tool attached to the conveyor into a borehole;

pumping a transparent fluid through a conduit traversing the borehole fishing device from the conveyor to a tip of a grapple at a distal end of the grapple into a portion of the borehole between the fish and the at least one camera mounted in the borehole fishing tool;

forming, using the at least one camera, at least one image, in real-time, of a fish in the borehole; transmitting, through a telemetry channel in the conveyor, the at least one image of the fish in the borehole to a computer system on an Earth's surface;

engaging, guided by the at least one image, the borehole fishing tool to the fish;

confirming, based on the at least one image, the fixed attachment of the fish to the borehole fishing tool; retracting the conveyor from the borehole;

and raising the borehole fishing device and the fish to the Earth's surface, wherein raising the borehole fishing device and the fish to the Earth's surface, further comprises verifying, using at least one image from the at least one camera, that the fish remains fixedly attached to the borehole fishing device while the fish is being raised to the Earth's surface.

2. The borehole fishing method of claim 1, wherein the conveyor is selected from a group consisting of a slickline, a wireline, a coil tubing, a wired coil tubing, a string of drill pipe, and a string of wired drill pipe.

3. The borehole fishing method of claim 1, further comprising: illuminating the fish using at least one light source mounted on the borehole fishing tool.

4. The borehole fishing method of claim 1, further comprising: transmitting instructions from the Earth's surface to an orientation device mounted in the borehole fishing tool to change the orientation of a grapple attached to the borehole fishing tool.

5. The borehole fishing method of claim 1, further comprising: transmitting, from the Earth's surface, instructions to activate an electromagnetic component mounted in the grapple to attract the grapple to the fish.

* * * * *